US007597214B2

(12) United States Patent
Levasseur

(10) Patent No.: US 7,597,214 B2
(45) Date of Patent: Oct. 6, 2009

(54) PRODUCT DISPENSER FOR A VENDING MACHINE

(75) Inventor: Joseph L. Levasseur, Chesterfield, MO (US)

(73) Assignee: Coin Acceptors, Inc., St. Louis, MO (US)

( * ) Notice: Subject to any disclaimer, the term of this patent is extended or adjusted under 35 U.S.C. 154(b) by 33 days.

(21) Appl. No.: 11/679,797

(22) Filed: Feb. 27, 2007

(65) Prior Publication Data

US 2007/0199951 A1 Aug. 30, 2007

Related U.S. Application Data

(60) Provisional application No. 60/777,160, filed on Feb. 27, 2006.

(51) Int. Cl.
*G07F 11/00* (2006.01)

(52) U.S. Cl. ..... 221/124; 221/268

(58) Field of Classification Search ..... 221/1, 221/2, 4, 5–8, 29, 34, 37, 40, 42, 43, 44, 221/69, 74–76, 79, 82, 84, 85, 88, 89, 92–95, 221/98, 106, 110, 112, 113, 114, 119, 121, 221/123, 124, 126, 129, 133, 167, 203, 212, 221/217, 218, 222, 223, 231, 237, 238, 253, 221/258, 270, 277

See application file for complete search history.

(56) References Cited

U.S. PATENT DOCUMENTS

| | | | | | |
|---|---|---|---|---|---|
| 2,564,552 | A * | 8/1951 | Verdery, Jr. | ..... | 221/75 |
| 4,124,142 | A * | 11/1978 | Albright | ..... | 221/75 |
| 4,560,088 | A * | 12/1985 | Tan | ..... | 221/75 |
| 4,991,739 | A * | 2/1991 | Levasseur | ..... | 221/14 |
| 5,024,350 | A * | 6/1991 | Shoemaker, Jr. | ..... | 221/75 |

* cited by examiner

*Primary Examiner*—Gene Crawford
*Assistant Examiner*—Kelvin L Randall, Jr.
(74) *Attorney, Agent, or Firm*—Polster, Lieder, Woodruff & Lucchesi, L.C.

(57) ABSTRACT

A system and method of delivering products from a vending machine having a number of selectable product storage locations comprising actively moving products using a product delivery mechanism associated with each of said selected product storage locations, driving an endless element having at least one engagement finger that is moved in a first direction by an actuator to engage one of a number of rotatable drive elements each connected to said product delivery mechanism, driving said endless element with said engagement finger in a second direction by reversing said actuator and going past said rotatable drive elements without engagement to provide for the selection of other products.

20 Claims, 15 Drawing Sheets

PRODUCT DISPENSER FOR A VENDING MACHINE

RELATED APPLICATIONS

The present application claims priority to U.S. Provisional Patent Application No. 60/777,160, filed Feb. 27, 2006. The contents of such application are incorporated herein by reference.

FIELD OF INVENTION

The present invention relates to vending machines. More specifically, the present invention relates to product dispensers for vending machines.

BACKGROUND OF THE INVENTION

There are many existing types of vending machines. Typically, the machines dispense a number of different classes of products from multiple selectable storage areas using a plurality of motors and or solenoids, implementing one per storage area. There are other vending systems that utilize robotic delivery systems.

U.S. Pat. No. 3,344,953 shows the use of helix coils and motors for vending articles from shelves.

U.S. Pat. No. 4,991,739 shows the use of an endless element to engage a release mechanism associated with one of a number of stacked columns for dropping the lowermost product from a stack.

U.S. Pat. No. 4,991,740 shows the use of an elongate, rotatable support means disposed below each column stack to engage a release mechanism associated with one of a number of stacked columns for dropping the lowermost product from a stack.

U.S. Provisional Application No. 60/686,729 shows a dispenser tray for vending articles of different shapes using auger driven pusher plates engaged by a robotic mechanism.

However, all of these systems require multiple electric motors or solenoids (prime movers") and more complex arrangements of parts. The present invention avoids this complexity by minimizing the number of prime movers required.

DESCRIPTION OF PREFERRED EMBODIMENTS

Figure 1:
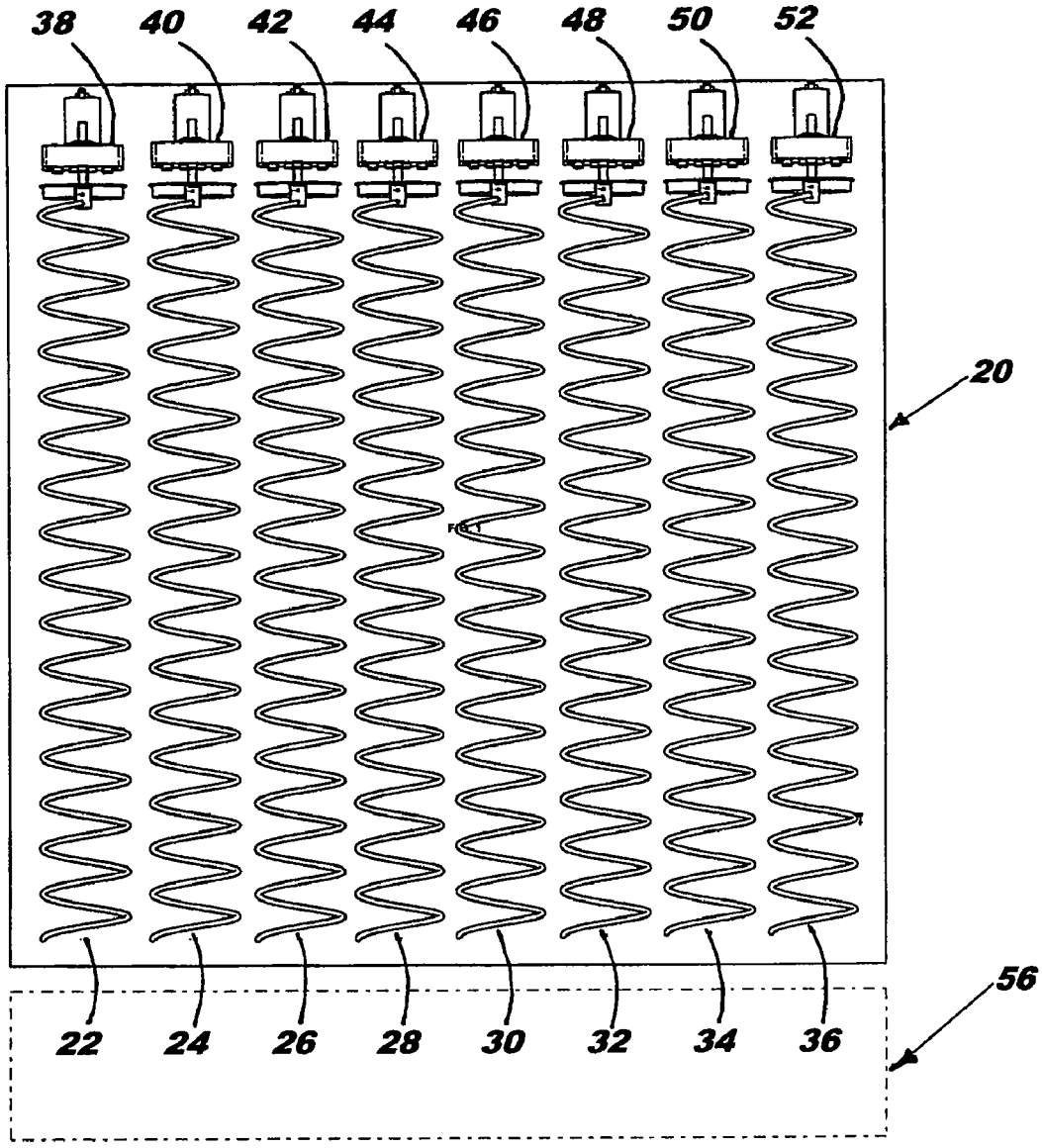
FIG. 1 is a top view of a prior art product dispenser.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The preferred embodiment of the present invention comprises a product dispenser having storage areas for products of different classes (i.e. chips, candy, gum, beverages, etc.) for a vending machine that, rather than using multiple solenoids or motors to dispense products, utilizes a single motor per product dispenser. A single vending machine will comprise a plurality of product dispensers that are disposed within the machine.

Referring to FIG. 1, a prior art product dispenser 20 is shown that has eight helical coil members 22 through 36. The helical coil members 22 are driven by motor gear boxes 38 through 52, respectively. Upon rotation of one of the helical coil members 22 through 36 by its motor gear box 38 through 52, the selected product is driven off the product dispenser 20 into a delivery area (not shown).

Figure 2:
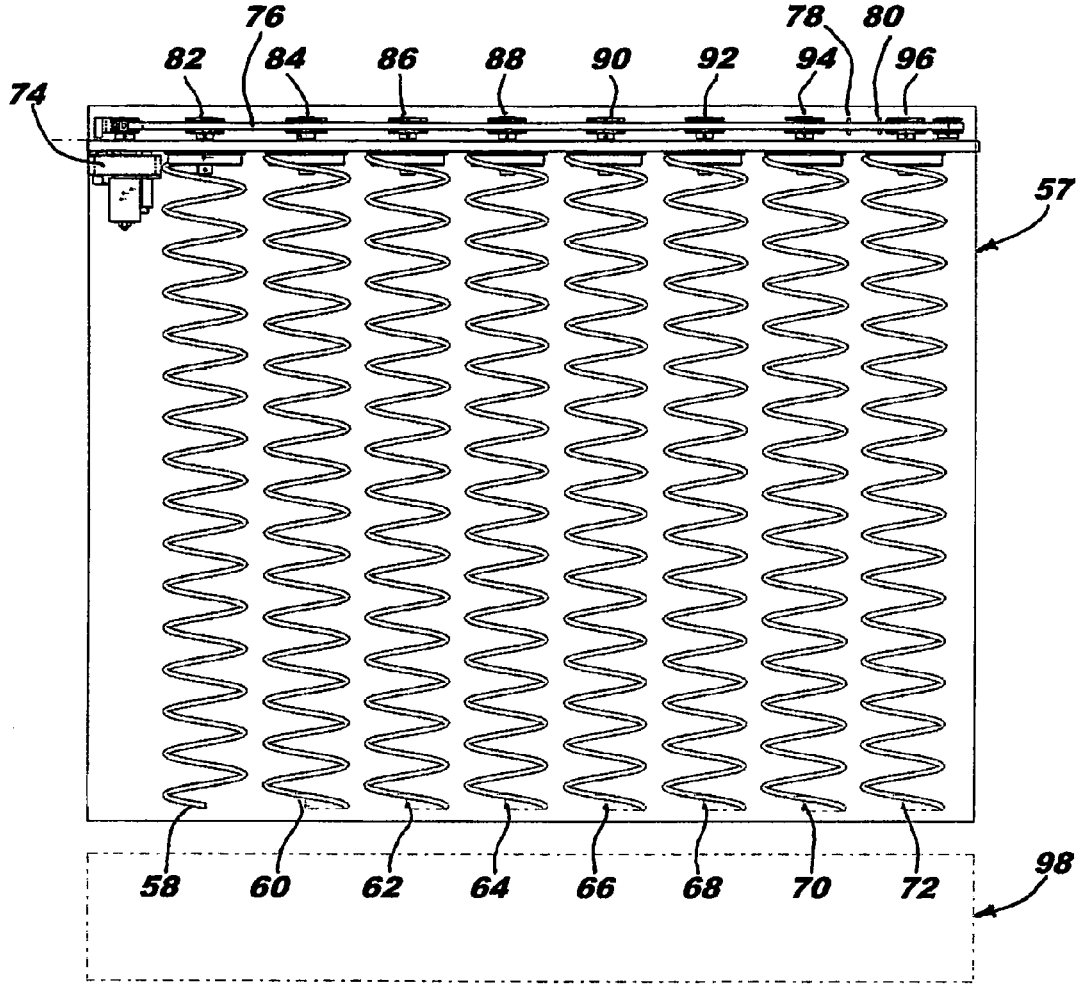
FIG. 2 is a top view of a product dispenser according to an embodiment of the present invention.

FIG. 2 is a simplified drawing showing the top view of a product dispenser 57 according to a preferred embodiment of the present invention. The product dispenser 57 comprises eight helical coils 58 through 72. One of ordinary skill in the art will recognize that any number of helical coils may be implemented, as space permits, in the product dispenser 57 without departing from the scope of the present invention. The motor gear box 74 drives an endless element 76. The endless element includes engagement fingers 78 and 80 which are attached to endless element 76. While two engagement fingers are preferred, one of ordinary skill in the art would recognize that more or less than two engagement fingers may be utilized without departing from the scope of the present invention. Moreover, rotatable drive elements 82 through 96 are associated with the helical coils 58 through 72.

Figure 3A:
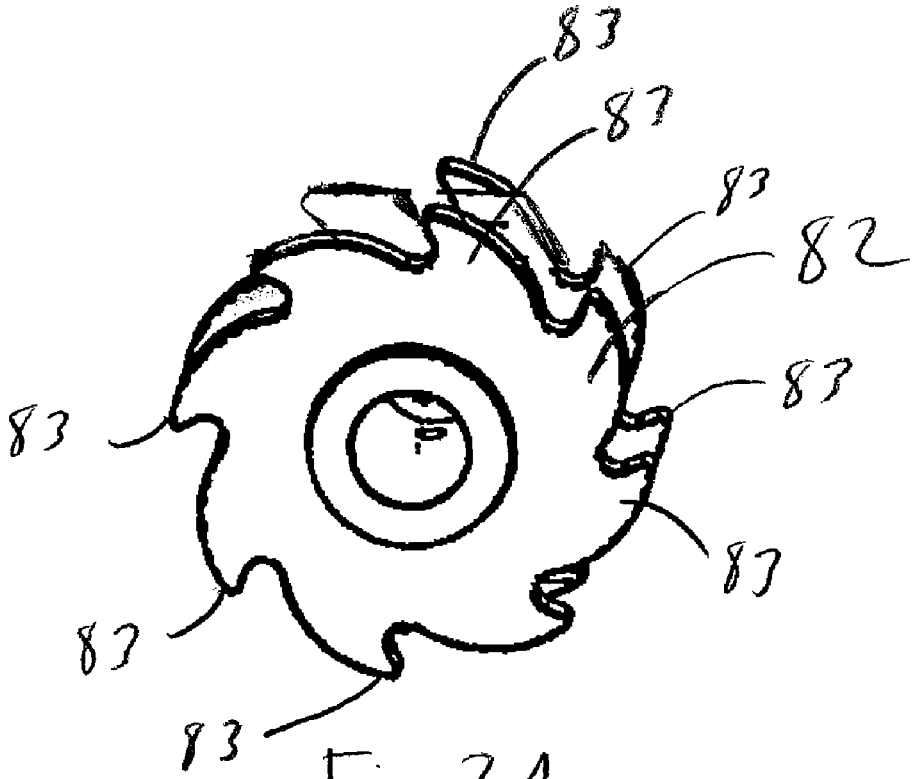
FIGS. 3A and 3B are front and side views of a rotatable drive element according to an embodiment of the present invention.
Figure 3B:
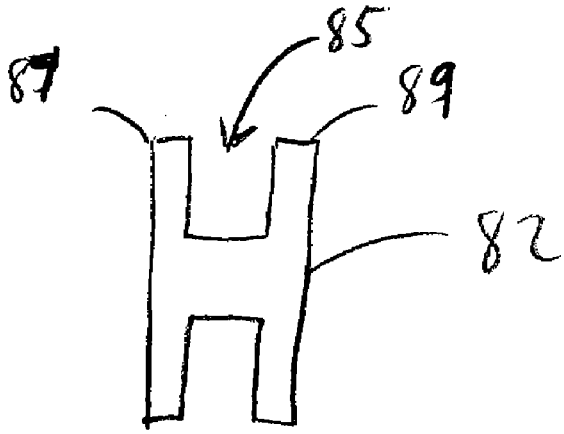

Referring to FIGS. 3A and 3B, the rotatable drive elements 82 comprise two rows of spaced apart outwardly extending protuberances 83. The area 85 between the rows of protuberances 83 is of a smaller diameter with respect to the outer diameter of the rows of protuberances. Each protuberance 83 of each row comprises a first side 87 which forms a portion adapted to engage one of the fingers 78 or 80. Each protuberance 83 of each row also comprises a second side 89 adapted to not engage one of the fingers 78 or 80.

Figure 4:
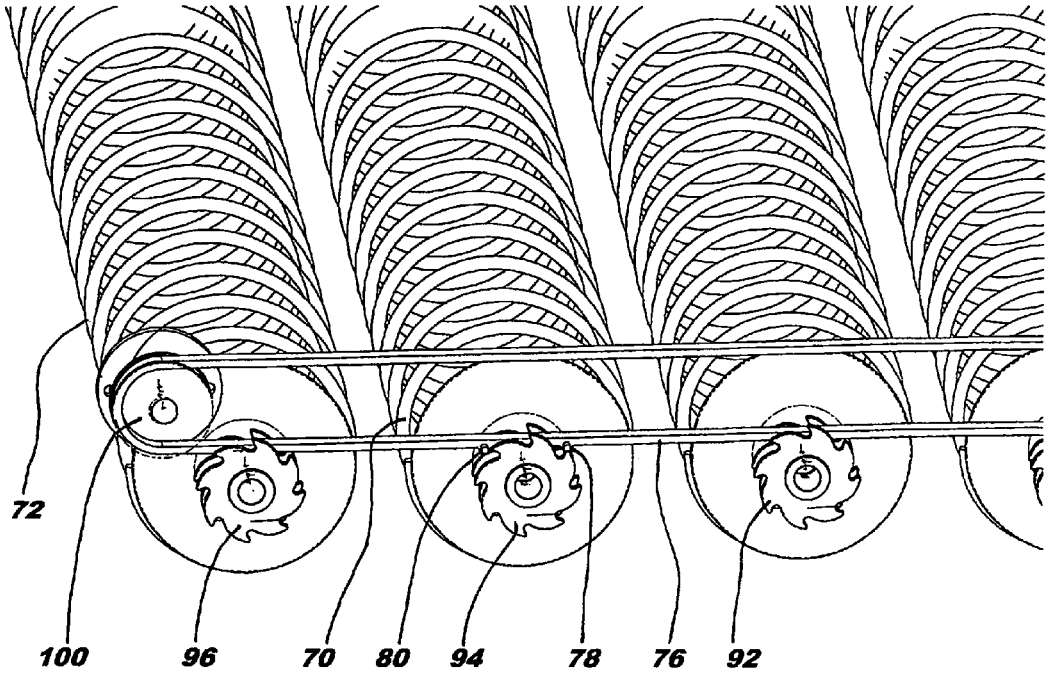
FIG. 4 is a partial rear view of a product dispenser according to an embodiment of the present invention.
Figure 5:
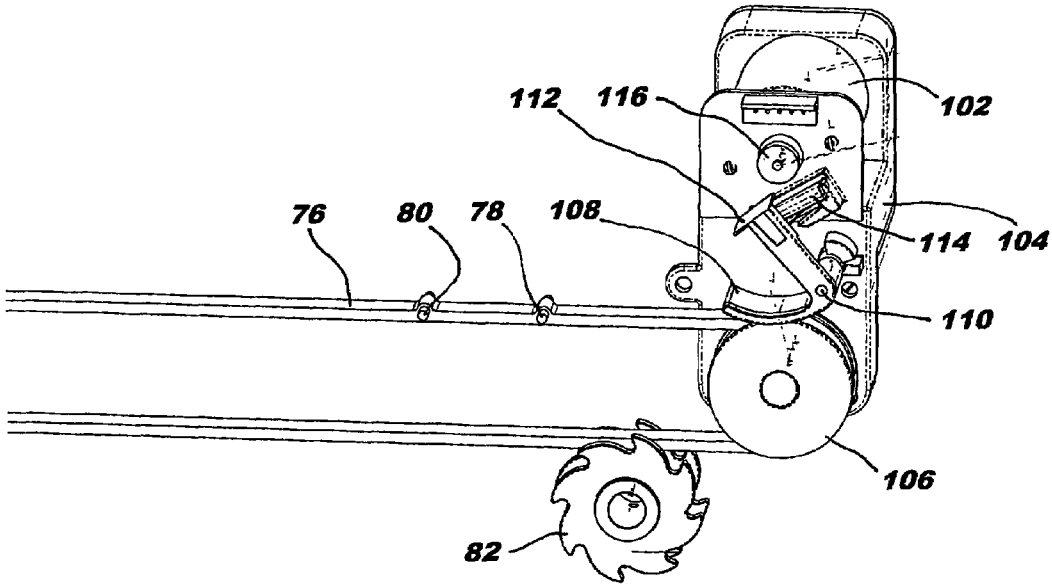
FIG. 5 is a perspective view of the product dispenser having a motor, an endless element comprising engagement fingers and a rotatable drive element according to an embodiment of the present invention.

Referring to FIGS. 4 and 5, endless element 76 is positioned over an idle pulley 100 and a timing pulley 106 to form a loop. A portion of the endless element 76 extends between the timing pulley 106 and the idle pulley 100 and passes between two rows of protuberances 83 of each of the rotatable drive elements 82. When the endless element 76 moves the engagement fingers 78 and 80 left to right, one finger 78 or 80 engages the first side of one of the protuberances from each row of protuberances of the rotatable drive elements 92 through 96. The engagement fingers 78 and 80 will advance the rotatable drive element 180 degrees if an entire pass is completed. The helix coils 58 through 72 are directly connected to the rotatable drive elements 82 through 96, respectively, to drive the selected product from the shelf. When the fingers 78 and 80 of the endless element 76 are moved from right to left, the engagement fingers 78 and 80 contact the second side 89 of the protuberances 83 of each row of protuberances 83 to pass without engagement. As a result, when the fingers 78 and 80 are moved from right to left, the fingers 78 and 80 do not effect rotation of the helical coils 58 through 72.

When the engagement fingers 78 and 80 pass around the timing pulley 106, they each momentarily cause a homing lever 108 to rotate at its pivot point 110 and place its magnetic blocker 112 between a Hall Effect device 114 and a magnetic field of the rotating motor magnet 116. This method provides that the Hall Effect device 114 serves to both track the endless element's 76 position by counting the motor 102 revolutions and to also determine a home position in which to start by using the engagement fingers 78 and 80 to interrupt the magnetic field from the rotating motor magnet 116 when they arrive at the timing pulley 106. The magnetic blocker 112 may be a small magnet which will block the Hall Effect device 114 from the motor magnet 116 field. It is anticipated to utilize other types of sensors and their energy sources to implement this method. One example is to interrupt a light path to a photocell by an encoding wheel and with a homing lever. Another would be to use a capacitive sensor and interrupt it with a homing device. Obviously, two sensors can be used separately for the two functions.

Figure 6:
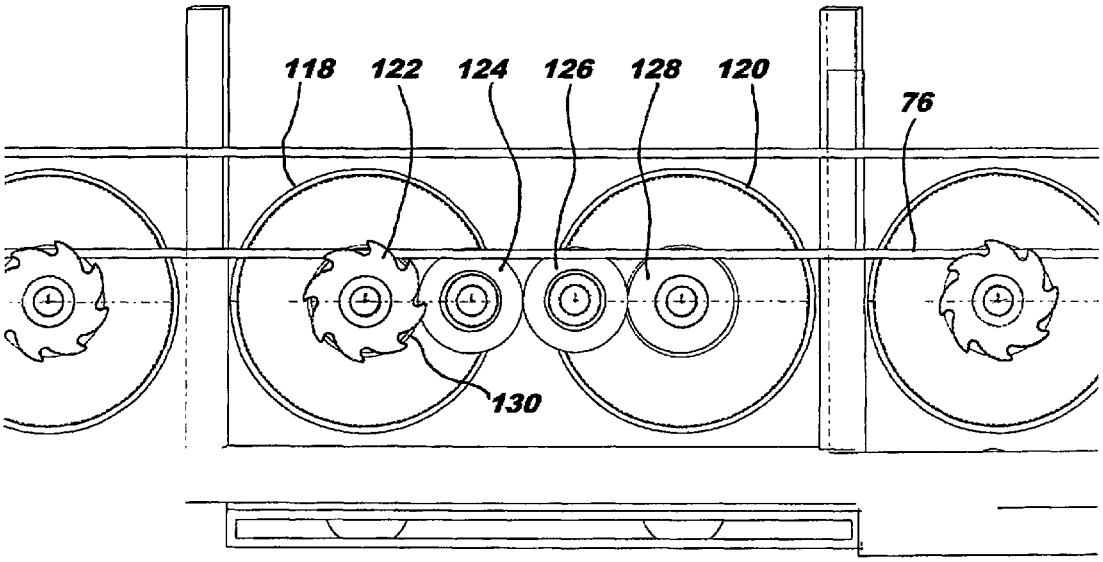
FIGS. 6 and 7 are rear and top views, respectively, of a product dispenser according to another embodiment of the present invention.
Figure 7:
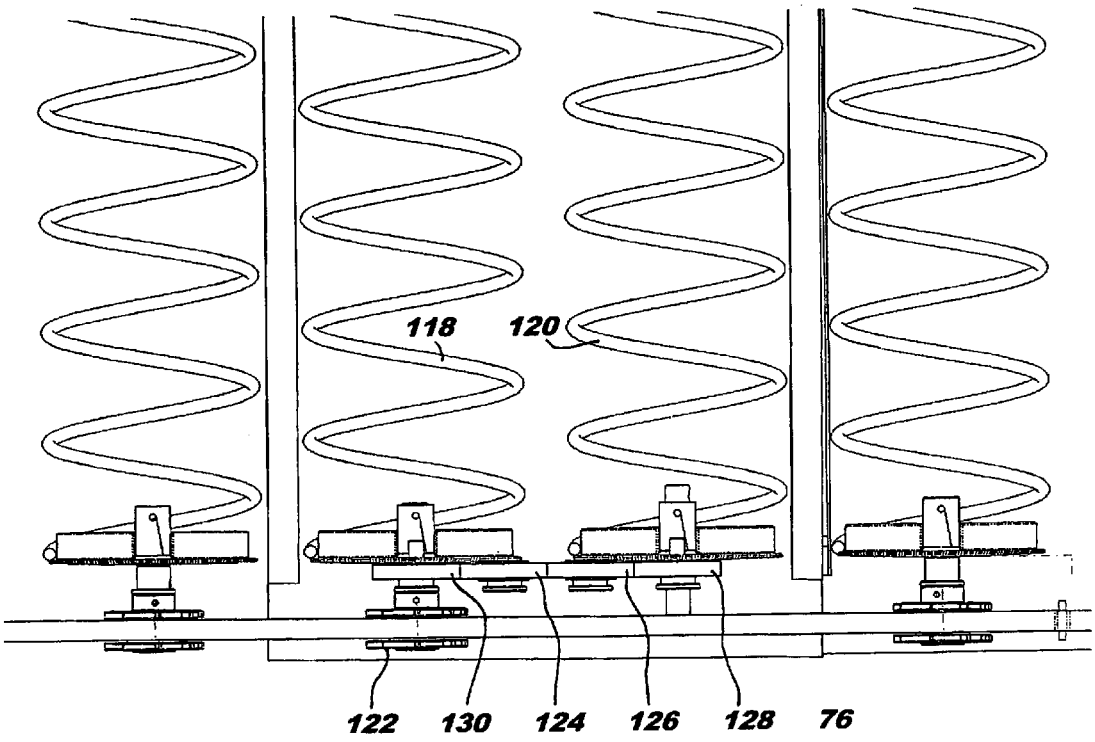

In some dispensers, two helical coils dispense a single product large product by rotating a right-hand wound and a left-hand wound helical coil. By rotating the left- and right-hand wound helical coils in opposite directions, the single product is dispensed. The present invention may be applied to the dual helical coil configuration as well, as shown in FIGS. 6 and 7. In FIGS. 6 and 7, two helical coils 118 and 120 are rotated in opposite directions by the same rotatable drive element 122 for vending the larger width products. This is accomplished by the finger 78 and 80 attached to endless element 76 rotating the rotatable drive element 122 which turns gear 124, which turns gear 126, which turn gear 128 which is attached to the helical coil 120. Thereby the rotatable driver 122 rotates the helix 118 in one direction, and through the gears 124, 126, and 128, the opposite helix 120 rotates in the other direction.

Figure 8:
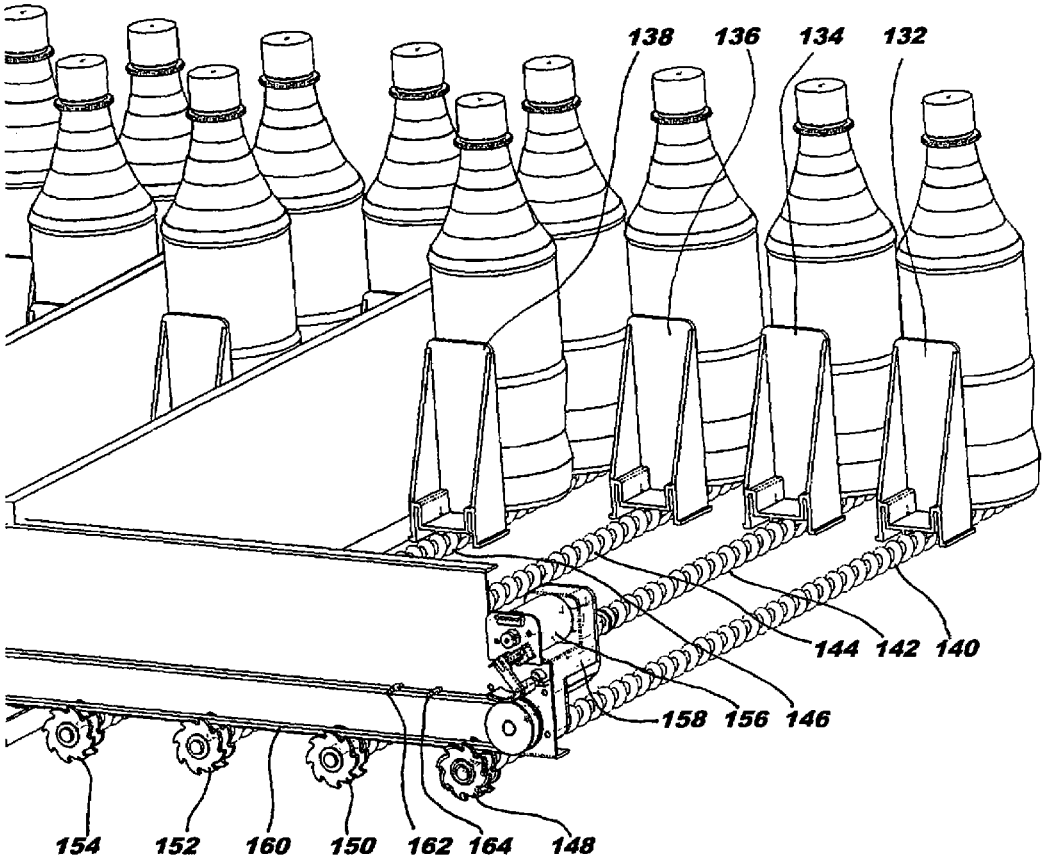
FIG. 8 is rear perspective view of a product dispenser utilizing an auger and push plate arrangement to vend products according to an embodiment of the present invention.

FIG. 8 shows a perspective view of a tray for actively dispensing products which are moved off the shelf by pushers 132, 134, 136, and 138 which are advanced by augers 140, 142, 144, and 146, and driven by rotatable drive elements 148, 150, 152, or 154 respectively, as shown. The motor 156 and gear box 158 use the same method to operate the endless element 160 and engagement fingers 162 and 164 as described in above.

Figure 9:
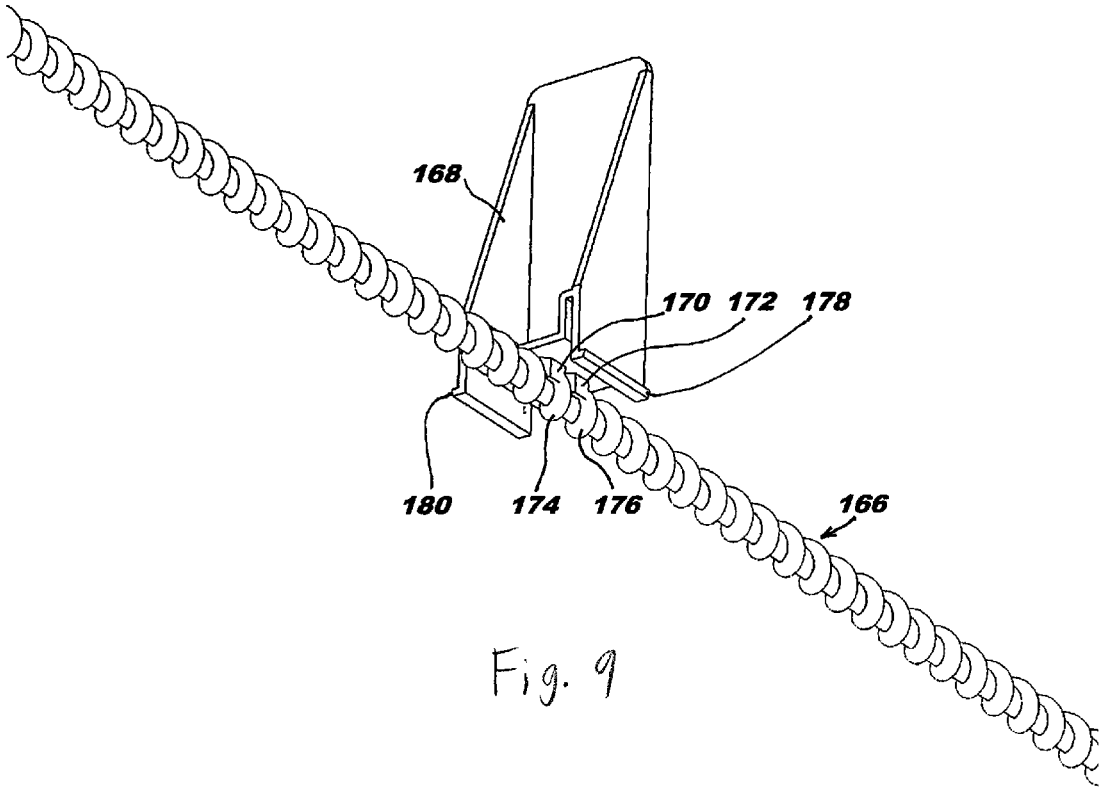
FIG. 9 is a perspective view of an auger and its push plate.

FIG. 9 is a perspective view of an auger 166 and its associated pusher plate 168 showing the portion of the pusher plate 168 with its two projections 170 and 172 which curve to conform to a portion of the auger 166 double threads 174 and 176. The pusher plate 168 maintains its relationship to the auger 166 by its projections 178 and 180 which slide along tracks on the shelf (not shown). The pusher plate actively advances the products along the axis of the auger 166 according its rotation.

Figure 10:
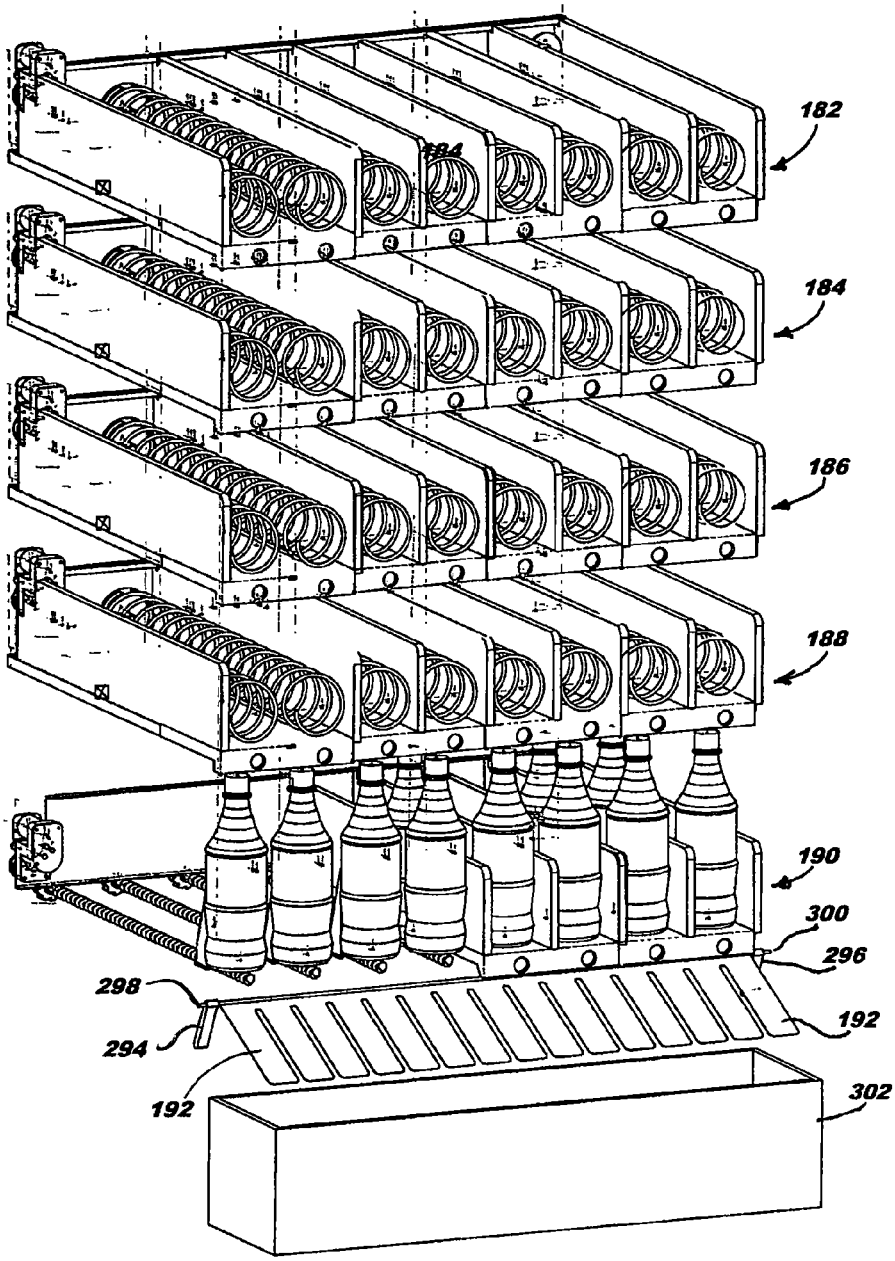
FIG. 10 is a perspective view of a vending machine interior according to an embodiment of the present invention.

FIG. 10 is a perspective view showing four product dispensers 182, 184, 186, and 188 using helical coils thereon and one shelf 190 using augers and push plates to actively advance products for vending. The method of the present invention a uses a light weight movable member 192 which is balanced by weights 294 and 296 and pivoted at points 298 and 300. Any sized product actively advanced from any shelf position will fall on the movable member 192 as it goes into a delivery port 302 just below it. The prior art of U.S. Pat. No. 6,732,014 senses a product's successful delivery in a snack vendor by using a number of well positioned optical paths in the drop zone. Another prior art method as taught in U.S. Pat. No. 4,359,147 uses a sensor positioned to respond to a successfully delivered product. Still another prior art system is shown in U.S. Pat. No. 6,794,634 using diffused optical beams to cover a large area for sensing products being vended. U.S. Pat. No. 6,708,079 discloses the multiple reflecting of an optic beam to cover an area to sense a product.

Figure 11:
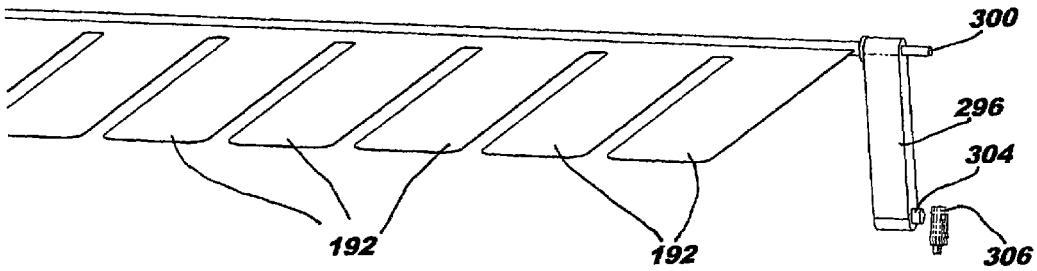
FIG. 11 is a perspective view of a light weight movable member according to an embodiment of the present invention.

FIG. 11 is a partial drawing showing the method of detecting the arrival of the vended product that moves the light weight movable member 192 which is balanced by the weight 296 at the pivot point 300 which has a small magnet 304 attached and is adjacent to the stationary mounted Hall Effect Sensor 306. The Hall Effect Sensor 306 detects the change in the magnetic field as the vended product moves the balanced assembly. The assembly may be spring biased instead of using a balancing weight 296. The movable member 192 may be serrated as shown or not, and be of a thin plastic or metal sheet and may be somewhat flexible. The sensor may be a photocell and a light emitting diode, whose light beam is changed by movement of the movable member 192. The pivot point 300 could be replaced by affixing one end of the flexible movable member and sensing a portion that flexes. Other sensors such as a mechanical switch can be used.

Figure 12:
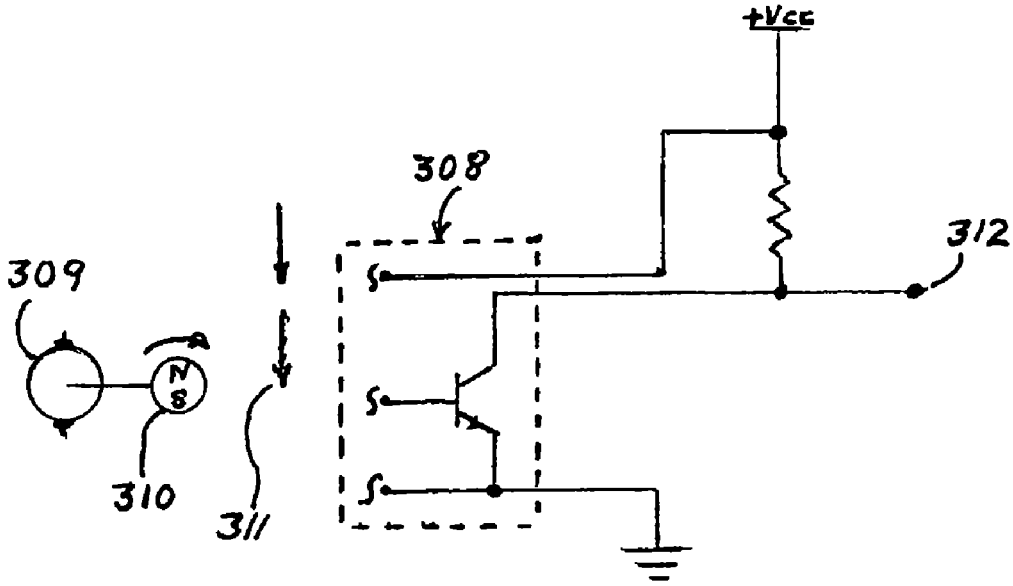
FIG. 12 is an electrical schematic according to an embodiment of the present invention.

FIG. 12 shows a schematic representation of a Hall Effect Sensor 308 and a related magnet 310 which when rotated by the motor 309 provides pulses at the output 312. It is used in a preferred embodiment of the present invention for determining the location of the endless element as described above. This is accomplished by the interrupting the magnet's 310 field from reaching the Hall Effect device 308 by blocking its magnetic field at position 311 by the magnetic blocker 112 of the homing lever 108 shown above.

Figure 13:
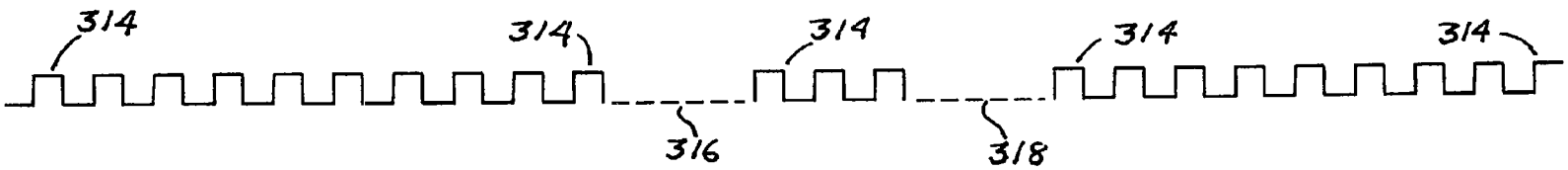
FIG. 13 is a pulses diagram of the operation of the control circuit of FIG. 12.

FIG. 13 is a simplified drawing of the output of a sensor used for determining the beginning position of the endless element as well as its progressive location in respect to its beginning position. When the motor magnet of FIG. 5 is rotated, the pulses 314 are generated and are shown interrupted twice, at points 316 and 318, by the magnetic blocker 112 of the homing lever 312 being moved by the two fingers on the endless element. Assuming that using a gearbox with a certain gear ratio results in one motor revolution moving the endless element 0.05 inches, and the distance between the rotatable drive elements is 3.4 inches. Then there would be 68 pulses generated to go from one rotatable drive element to the next.

One or more sets of engagement fingers can be spaced apart on the endless element to reduce access times for product dispensing. The endless element employed can be of various belt or chain types. The motors used can be AC, DC, or stepper motors. The helix coils, or augers with or without push plates which are used to actively drive the products off of each product dispenser can also be accomplished using product conveyor belts. A conveyor belt, on which the products are placed, is advanced by its rotatable drive element using bevel gears for reorienting the direction of required rotation, since the endless element moves across the rear of the shelf from side to side, and the conveyor belt would be moved from the back to front of the shelf.

Figures 13, 14:
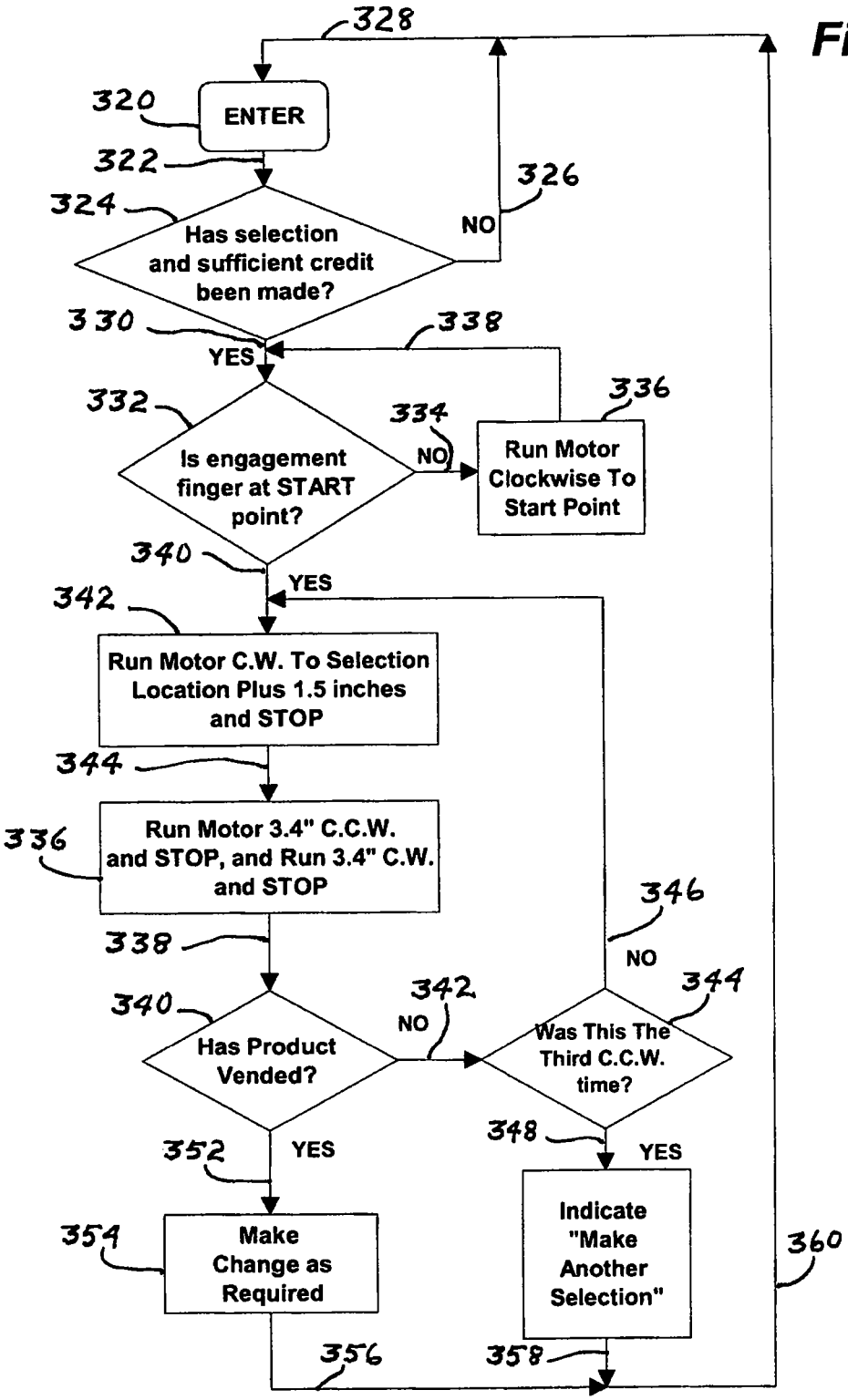
FIGS. 14 and 15 are flow charts showing methods of controlling a vending machine according to an embodiment of the present invention.

Referring now to the flow chart in FIG. 14 wherein the blocks have appropriate legends, and in particular to the enter block 320 where the sequence begins through path 322 to decision block 324. At the block 324 the processing means checks to determine if a selection has been made, and if sufficient credit has been entered, and if not, the operational sequence follows the path 326 which connects to path 328 which returns back to the enter block 320. If the determination is yes, then the operational sequence follows path 330 to decision block 332.

At block 332 the processing means checks to determine if the engagement finger of the endless element is at its start point. If not, the operational sequence follows the path 334 to the block 336 whereby the motor is run clockwise to the start point and after which the operational sequence follows the path 338 to the path 330 to the block 332. If the block 332 decision is yes, then the operational sequence follows path 340 to block 342.

At block 342 the processing means runs the motor clockwise to the customer selected product storage location which has a predetermined number of pulses 314 as shown in FIG. 12 from the motor magnet 116 shown in FIG. 4. The motor is also run clockwise an additional preset distance past the selected location and stopped. The operational sequence thereafter follows the path 344 to block 336.

At block 336 the processing means runs the motor counter-clockwise a prescribed distance and stopped, and then clockwise for the same prescribed distance, and stopped. This provides the operation of the two engagement fingers 78 and 80 to rotate the rotatable drive element 94 as shown in FIG. 3 half a complete turn. During the counter-clockwise rotation the engagement fingers 78 and 80 each rotate the rotatable drive element 78 for one forth of a complete rotation, thus a total one half rotation. The second engagement finger engages right after the first one disengages. The operation thereafter follows path 338 to decision block 340.

At block 340 the processing means checks to see if the product has vended and if not, then the sequence follows the path 342 to the decision block 344 where the processing means determines if the counter clockwise operation is the third time. If not, then the operational sequence follows the path 346 to the path 340. If yes, then the sequence follows the path 348 to the block 350 which operates a "make another selection" indication, and the sequence continues to path 358, path 360, and path 328 to entry block 320.

If the product has vended then the operational sequence follow the path 352 to operation block 354 wherein the processing means makes any required change as a result of the amount credited, minus the price of the vended product. Upon completion of making change, the sequence follows the path 356, 360 and 328 to the enter block 320.

Figure 15:
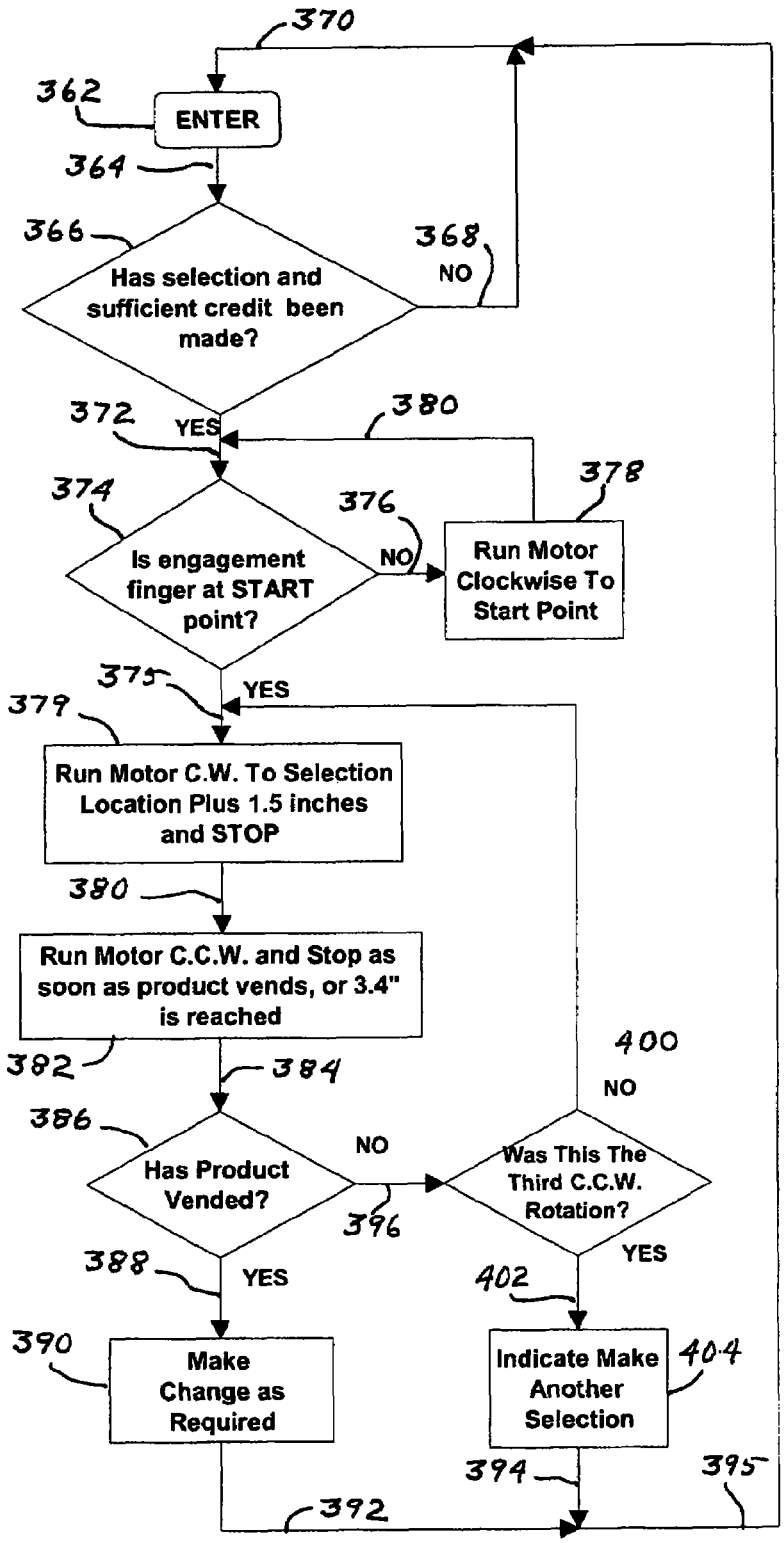

Referring now to the flow chart in FIG. 15 which is similar to that of FIG. 13 but has a change in its operation to provide flexibility for the variable vend cycles that may occur with certain product packages and in their placement within the delivery mechanism. Now in FIG. 15 and in particular to the enter block 362 where the sequence begins through path 364 to decision block 366. At the block 366 the processing means checks to determine if a selection has been made, and if sufficient credit has been entered, and if not, the operational sequence follows the path 368 which connects to enter path 370 which returns back to the enter block 362. If the determination is yes, then the operational sequence follows path 372 to decision block 374.

At block 374 the processing means checks to determine if the engagement finger of the endless element is at its start point. If not, the operational sequence follows the path 376 to the block 378 whereby the motor is run clockwise to the start point and after which the operational sequence follows the path 380 to the path 372 to the block 374. If the block 374 decision is yes, then the operational sequence follows path 375 to block 379.

At block 378 the processing means runs the motor clockwise to the customer selected product storage location until a predetermined number of pulses 314, as drawn in FIG. 12 from the motor magnet 116 as shown in FIG. 4. The motor is also run clockwise an additional preset distance past the selected location before stopping. The operational sequence thereafter follows the path 380 to block 382.

At block 382 the processing means runs the motor counter-clockwise and is stopped as soon as a product has vended, or 3.4 inches has been reached and the operation follows the path 384 to the decision block 386.

At block 386 the processing means checks to see if the product has vended or not. If yes, the operation sequence follows path 388 to operations block 390 wherein the processing means makes any required change as a result of the amount credited, minus the price of the vended product, then the operational sequence follows the path 392, to path 394 and to the enter path 370. If the product has not yet vended, then operational sequence follows the path 396 to the decision block 398 where the processing means determines if the counter clockwise operation was the third time. If not, then the operational sequence follows the path 400 to the path 375. If it was the third time, then the operational sequence thereafter follows path 402 to the operation block 404.

At block 404 the processing means instructs the customer to make another selection, thereafter follows path 394 and path 395 to return to the enter path 370.

Thus there has been shown and described novel methods for improving the operation and increasing the versatility of vending which eliminate many of the more costly and more troublesome mechanical and electromechanical devices which have been used for vending in the past. It will be apparent to those skilled in the art, however, that many changes, modifications, variations and other uses and applications of the subject means are possible and all such changes, modifications, variations and other uses and applications which do not part the spirit and scope of the invention are deemed to be covered by the invention which is limited only by the claims which follow.

What is claimed is:

1. A device for dispensing products from a vending machine having a number of product storage locations comprising:

apparatus associated with each product storage location for advancing products within the storage location;

an endless element operated by a motor and further comprising at least one engagement finger;

a rotatable drive element associated with each product storage location, the rotatable drive element configured to engage the engagement finger to rotate the rotatable drive element when the engagement finger is driven past the rotatable drive element in a first direction and the rotatable drive element configured to not engage the engagement finger to rotate the rotatable drive element when the engagement finger is driven past the rotatable drive element in a second direction, wherein when the rotatable drive element is rotated a predetermined number of degrees a product is dispensed from the product storage location; and wherein the apparatus associated with each product storage location for advancing products within the storage location comprises at least one helical coil.

2. The device of claim 1 wherein the rotatable drive member comprises at least one row of protuberances for engaging the engagement finger.

3. The device of claim 1 wherein the rotatable drive member comprises a plurality of rows of protuberances for engaging the engagement finger.

4. The device of claim 3 wherein the endless element is disposed between two rows of protuberances.

5. The device of claim 1 wherein the apparatus associated with each product storage location for advancing products within the storage location comprises a plurality of helical coils.

6. The device of claim 1 including a location device for contacting the engagement finger for determining the present location of the engagement finger.

7. The device of claim 6 wherein the location device comprises a magnet for blocking a Hall effect sensor.

8. The device of claim 7 wherein the Hall effect sensor also counts the revolutions of a motor for driving the endless element.

9. A device for dispensing products from a vending machine having a number of product storage locations comprising:

apparatus associated with each product storage location for advancing products within the storage location;

an endless element operated by a motor and further comprising at least one engagement finger;

a rotatable drive element associated with each product storage location, the rotatable drive element configured to engage the engagement finger to rotate the rotatable drive element when the engagement finger is driven past the rotatable drive element in a first direction and the rotatable drive element configured to not engage the engagement finger to rotate the rotatable drive element when the engagement finger is driven past the rotatable drive element in a second direction, wherein when the rotatable drive element is rotated a predetermined number of degrees a product is dispensed from the product storage location; and wherein the apparatus associated with each product storage location for advancing products within the storage location comprises a pusher driven by an auger.

10. The device of claim 9 wherein the rotatable drive member comprises at least one row of protuberances for engaging the engagement finger.

11. The device of claim 9 wherein the rotatable drive member comprises a plurality of rows of protuberances for engaging the engagement finger.

12. The device of claim 9 including a location device for contacting the engagement finger for determining the present location of the engagement finger.

13. The device of claim 12 wherein the location device comprises a magnet for blocking a Hall effect sensor.

14. A method of delivering products from a vending machine having a number of selectable product storage locations, comprising actively moving products using a product delivery mechanism associated with each of said selected product storage locations, the product delivery mechanism selected from the group consisting of a helical coil and a pusher that is moved by rotation of an auger, driving an endless element having at least one engagement finger that is moved in a first direction by an actuator to engage one of a number of rotatable drive elements each connected to said product delivery mechanism, driving said endless element with said engagement finger in a second direction by reversing said actuator and going past said rotatable drive elements without engagement to provide for the selection of other products.

15. The method of claim 14 further comprising the step of determining the delivery of a product by sensing a moveable member that is moved by a delivered product.

16. A method of delivering products from a vending machine having a number of selectable product storage locations, comprising actively moving products using a product delivery mechanism associated with each of said selected product storage locations, driving an endless element having at least one engagement finger that is moved in a first direction by an actuator to engage one of a number of rotatable drive elements each connected to a said product delivery mechanism, driving said endless element with said engagement finger in a second direction by reversing said actuator and going past said rotatable drive elements without engagement to provide for the selection of other products, and said rotatable drive elements having outer projections oriented and configured allowing only one direction of rotation by said engagement finger; and wherein said product delivery mechanism is selected from the group consisting of a helical coil and a pusher driven by an auger.

17. The method of claim 16 wherein said determination of delivery by sensing is using at least one optical beam located in a product delivery path.

18. The method of claim 16 wherein said determination of delivery by sensing is using at least one Hall Effect device located to sense a product delivery path.

19. The method of claim 16 wherein said determination of delivery by sensing is using a sensor located to sense a product delivery path.

20. A vending machine for delivering products from a number of selectable product storage locations, the improvement comprising a product delivery mechanism associated with each of said selected product storage locations, an endless element having at least one engagement finger that is moved in a first direction by an actuator to engage one of a number of rotatable drive elements each connected to a said product delivery mechanism, said endless element with said engagement finger when driven in a second direction by reversing said actuator goes past said rotatable drive elements without engagement to provide for the selection of other products, and said rotatable drive elements configured with outer projections that provide only one direction of rotation by said engagement finger, wherein said product delivery mechanism is selected from the group consisting of a helical coil and a pusher driven by an auger.

* * * * *